US006244974B1

(12) United States Patent
Hanberry, Jr.

(10) Patent No.: US 6,244,974 B1
(45) Date of Patent: Jun. 12, 2001

(54) PUTTER

(76) Inventor: Edwin E. Hanberry, Jr., 5413 Rowe Trail, Pace, FL (US) 32571

( * ) Notice: Subject to any disclaimer, the term of this patent is extended or adjusted under 35 U.S.C. 154(b) by 0 days.

(21) Appl. No.: 09/285,914

(22) Filed: Apr. 2, 1999

(51) Int. Cl.[7] ..... A63B 69/36; A63B 53/04

(52) U.S. Cl. ..... 473/242; 473/251; 473/340; 473/330

(58) Field of Search ..... 473/324, 325, 473/330, 331, 340, 341, 342, 313, 268, 314, 251, 252, 255, 242; D21/736, 743, 744

(56) References Cited

U.S. PATENT DOCUMENTS

D. 58,209 * 6/1921 Bacheller .
D. 234,962 * 4/1975 Swash .
D. 245,441 * 8/1977 Middlestadt .
D. 257,872 * 1/1981 MacDougall .
D. 306,629 * 3/1990 Shearer .
D. 317,490 * 6/1991 Pelz .
D. 356,356 * 3/1995 Jacobs .
D. 365,615 * 12/1995 Shimantani .
D. 381,382 * 7/1997 Fenton .
D. 413,951 * 9/1999 Storer .
2,954,231 * 9/1960 MacIntyre .
3,143,349 * 8/1964 MacIntrye .
3,319,962 * 5/1967 Summers .
3,374,027 * 3/1968 Jacobs .
3,448,981 * 6/1969 Anweiler .
3,459,426 * 8/1969 Sherwood .
3,486,755 * 12/1969 Hodge .
3,888,484 * 6/1975 Zitko .
4,141,556 * 2/1979 Paulin .
4,174,839 * 11/1979 Marrs .
4,712,798 * 12/1987 Preato .
5,082,277 * 1/1992 Gingold .
5,620,379 * 4/1997 Borys .

* cited by examiner

*Primary Examiner*—Sebastiano Passaniti
(74) *Attorney, Agent, or Firm*—Peter Loffler

(57) ABSTRACT

A putter has a body member that has a top surface and a bottom surface joined by a first face, a second face disposed at an obtuse angle relative to the first face, a third face, a fourth face disposed at an acute angle relative to the third face, and a fifth face disposed at an obtuse angle relative to the first face. A groove system runs from the second face through to the fifth face via the third face and the fourth face. A plurality of azimuth lines radiate outwardly from the connection point of the third face and the fourth face toward one of the first face, the second face, or the fifth face. A shaft is attached to the top surface of the body member.

6 Claims, 2 Drawing Sheets

PUTTER

BACKGROUND OF THE INVENTION

1. Field of the Invention

The present invention relates to a putter that is balanced and that has aiming capabilities.

2. Background of the Prior Art

The art of putting has been said to be the key to any successful golfer's game. Although some might not agree with such a statement, the putting portion of each golfer's game is crucial, as the putter is the only club that is used on almost all holes of a golf game—the few times the putter is not used is when a golfer lands the ball in the hole from a green approach shot or a hole in one.

As a result, many serious golfers devote substantial time and energy to putting. Such golfers also tend to spend a lot of a money on the latest and greatest putter on the market.

One of the key components of any successful putter is balance. A well balanced golf club permits the golfer to hit the ball in a desired direction—thereby allowing the golfer to better anticipate the desired trajectory of the ball—without the putter twisting or torquing in another direction. A balanced putter allows the golfer to impact a desired and consistent force on the shot thereby allowing the golfer to better anticipate the distance of a putt.

Therefore, there is a need in the art for a balanced putter that allows a golfer to anticipate the trajectory of a putt and the force impacted on the ball. Ideally, such a putter will have an aiming aid thereon.

SUMMARY OF THE INVENTION

The putter of the present invention addresses the aforementioned needs in the art. The putter is a well balanced golf club that allows a golfer to hit a ball in a desired direction and with a desired amount of force. The putter does not tend to twist or otherwise torque during a putt.

The putter of the present invention is comprised of a body member having a top surface and a bottom surface joined by a first face, a second face that is disposed at an obtuse angle relative to the first face, a third face, a fourth face, and a fifth face that is disposed at an obtuse angle relative to the first face. A shaft is attached to the top surface in any appropriate fashion. Placement of the shaft can be such that the putter is designed for either left handed shooters or for right handed shooters. As such, the shaft will be disposed either closer to the second face relative to the fifth face, or closer to the fifth face relative to the second face, respectively. The putter can be constructed such that the third face is disposed at an acute angle relative to the fourth face and that these two faces abut at a corner, or an intervening face can connect the third face and the fourth face. Either a single continuous groove extends from the second face to the fifth face, or a series of grooves are disposed within the second through the fifth faces.

A plurality of azimuth lines extend from proximate the corner, each azimuth line extending toward one of the first face, the second face, or the fifth face. The azimuth lines, which can be ground into the top surface, can be raised portions on the top surface, or can be painted on, drawn on, etc., assist a golfer in lining up a putt.

BRIEF DESCRIPTION OF THE DRAWINGS

Similar reference numerals refer to similar parts throughout the several views of the drawings.

DESCRIPTION OF THE PREFERRED EMBODIMENT

Figure 1:
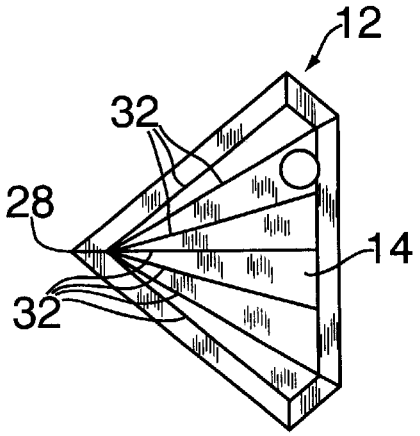
FIG. 1 is a top plan view of the putter of the present invention.
Figure 2:
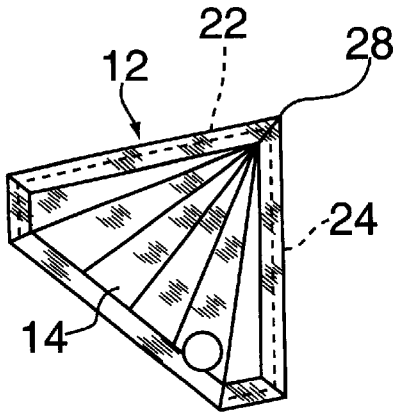
FIG. 2 is a top plan view of the putter of the present invention showing the grooves.
Figure 3:
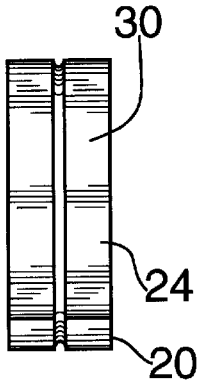
FIG. 3 is a side elevation view of the putter.
Figure 4:
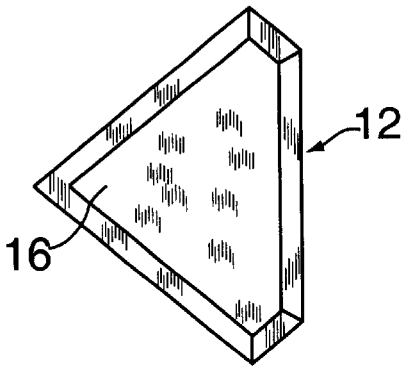
FIG. 4 is a bottom plan view of the putter of the present invention.
Figure 5:
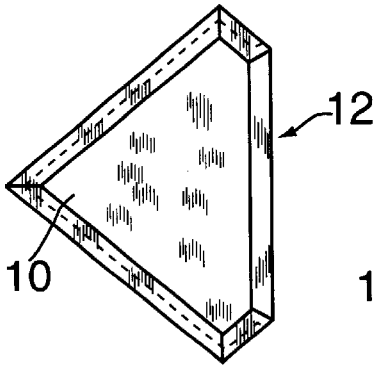
FIG. 5 is a bottom plan view of the putter of the present invention showing the grooves.
Figure 6:
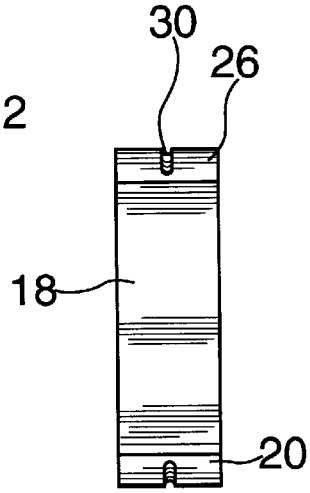
FIG. 6 is a front elevation view of the putter.
Figure 7:
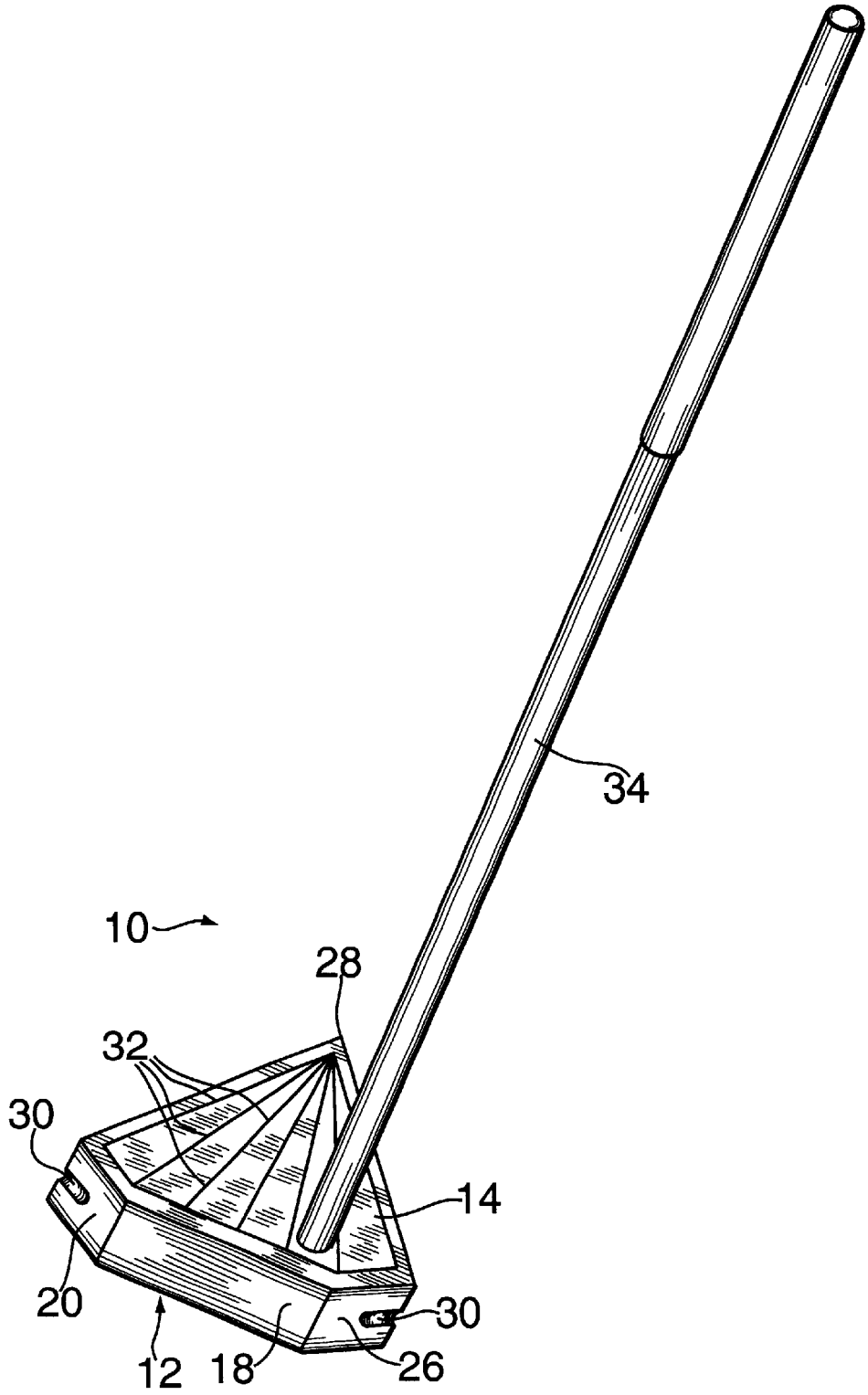
FIG. 7 is a perspective view of the putter.

Referring now to the drawings, it is seen that the putter of the present invention, generally denoted by reference numeral 10, is comprised of a body member 12 having a top surface 14 and a bottom surface 16 joined by a first face 18, a second face 20, a third face 22, a fourth face 24, and a fifth face 26. The body member 12 can be made from any appropriate golf club material such as metal, polycarbonate, titanium, blends, etc. The second face 20 is disposed at an obtuse angle relative to the first face 18 and the fifth face 26 is disposed at an obtuse angle relative to the first face 18. The third face 22 is disposed at an acute angle relative to the fourth face 24 and the abutting faces form a corner 28. Alternately, an intervening face (not illustrated) can be used to create the joiner of the third face 22 and the fourth face 24. A groove system 30 extends from the second face 20, through the third face 22, through the fourth face 24 (and the intervening face if used), and through the fifth face 26. The groove system 30 can be one continuous groove or it can be discrete grooves disposed within each face.

A plurality of azimuth lines 32 are disposed on the top surface 14 of the body member 12, and extend outwardly from proximate the corner 28 (or from proximate the joinder of the third face 22 and the fourth face 24), each azimuth line 32 extending toward one of the first face 18, the second face 20, or the fifth face 26. The azimuth lines 32 can be milled into the top surface 14, can be raised portions on the top surface 14, or can be drawn or painted onto the top surface 14 in any appropriate fashion.

A shaft 34 of any appropriate design is attached to the top surface 14 of the body member 12 in any appropriate fashion. The shaft 34 can be attached closer to the second face 20 relative to the fifth face 26 for left handed golfers, or the shaft 34 can be attached closer to the fifth face 26 relative to the second face 20 for right handed golfers (or right in the middle between the second face 20 and the fifth face 26). The exact placement of the shaft 34 onto the top surface 14 is dependent on the dimensions of the body member 12, the dimensions of the shaft 34 and the lie angle desired between the shaft 34 and the first face 18.

The particular geometry of the putter 10 of the present invention produces a putter that is well balanced and that allows a golfer to hit the ball along an intended trajectory with the threat of push or pull torquing of the putter 10 during the swing minimized. Additionally, the putter 10 allows a golfer to be able to hit the ball with a desired amount of force for greater predictability of distance of travel of the ball. The groove system 30 disables the second face 20, the third face 22, the fourth face 24 (and the intervening face, if used), and the fifth face 26 from being used as hitting faces in keeping with the current golf rules of the United States Professional Golfers Association. The azimuth lines 32 on the top surface 14 of the body member 12 allow a golfer to line up a shot more correctly thereby allowing the golfer to estimate a truer line of travel of the golf ball.

While the invention has been particularly shown and described with reference to an embodiment thereof, it will be appreciated by those skilled in the art that various changes in form and detail may be made without departing from the spirit and scope of the invention.

What is claimed is:

1. A putter comprising:

a body member having a top surface and a bottom surface joined by a first face, a second face disposed at an obtuse angle relative to the first face, a third face, a fourth face, and a fifth face disposed at an obtuse angle relative to the first face;

a groove extending from the second face, through the third face, through the fourth face, and terminating within the fifth face; and a shaft attached to the top surface.

2. The putter as in claim 1 wherein the third face is disposed at an acute angle relative to the fourth face.

3. The putter as in claim 1 wherein the shaft is disposed closer to the second face then to the fifth face.

4. The putter as in claim 1 wherein the shaft is disposed closer to the fifth face then to the second face.

5. The putter as in claim 1 wherein the third face abuts the fourth face at a corner.

6. The putter as in claim 5 further comprising a plurality of azimuth lines extending from proximate the corner, each azimuth line extending toward one of the first face, the second face, or the fifth face.

* * * * *